US007445327B2

(12) United States Patent
Nukui

(10) Patent No.: US 7,445,327 B2
(45) Date of Patent: Nov. 4, 2008

(54) FLAT PLATE-SHAPED PLATEN AND INKJET RECORDING APPARATUS USING THE SAME

(75) Inventor: Kosuke Nukui, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 488 days.

(21) Appl. No.: 11/071,256

(22) Filed: Mar. 4, 2005

(65) Prior Publication Data

US 2005/0195258 A1 Sep. 8, 2005

(30) Foreign Application Priority Data

Mar. 5, 2004 (JP) ..... 2004-062888
Jul. 27, 2004 (JP) ..... 2004-219075

(51) Int. Cl.
*B41J 2/01* (2006.01)

(52) U.S. Cl. ..... 347/104; 347/101

(58) Field of Classification Search ..... 347/104, 347/101

See application file for complete search history.

(56) References Cited

U.S. PATENT DOCUMENTS 5,870,114 A * 2/1999 Numata et al. ..... 347/16
6,239,817 B1 * 5/2001 Meyer ..... 347/36
6,940,618 B2 * 9/2005 Kinas ..... 358/1.4
2002/0089564 A1 * 7/2002 Ohashi ..... 347/41
2002/0118266 A1 * 8/2002 Yamaguchi et al. ..... 347/104
2003/0214549 A1 * 11/2003 Ogasawara ..... 347/35
2004/0183850 A1 * 9/2004 Takeuchi et al. ..... 347/19

FOREIGN PATENT DOCUMENTS

JP 10226059 A * 8/1998
JP 2000-109243 4/2000
JP 2000118058 A * 4/2000
JP 2000158644 A * 6/2000
JP 2003276262 A * 9/2003

* cited by examiner

*Primary Examiner*—Stephen D Meier
*Assistant Examiner*—Leonard S Liang
(74) *Attorney, Agent, or Firm*—Banner & Witcoff, Ltd.

(57) ABSTRACT

A flat plate-shaped platen is used for an inkjet recording apparatus including a side-end detection unit and a recording head. The platen includes a blocking wall that prevents ink ejected from the recording head from entering an area, which faces a movement area where the side-end detection unit moves. The blocking wall extends in a direction intersecting with a conveyance direction of a recording medium.

22 Claims, 9 Drawing Sheets

FLAT PLATE-SHAPED PLATEN AND INKJET RECORDING APPARATUS USING THE SAME

BACKGROUND OF THE INVENTION

1. Field of the Invention

The present invention relates to a flat plate-shaped platen provided on an inkjet recording apparatus, which detects a side end of a recording medium conveyed and performs recording thereto, the platen supporting the recording medium during the recording. Further, the present invention relates to an inkjet recording apparatus detecting a side end of a recording medium conveyed and performing recording thereto.

2. Description of the Related Art

An inkjet recording apparatus such as a printer and a facsimile are disclosed in JP-A-2000-109243. The inkjet recording apparatus has a flat plate-shaped platen, which guides a conveyed recording medium in a horizontal direction; and a recording head, which is movable in a direction perpendicular to the conveyance direction of the recording medium. The inkjet recording apparatus conveys a recording medium placed on the flat plate-shaped platen and performs recording on the recording medium while the recording head facing the recording medium moves.

The recording head is provided with a light-emitting element having an LED, and a light-receiving element having a phototransistor, both of which are used for detecting the width of the recording medium. The light-emitting element is driven while the recording head is moved in a direction perpendicular to the conveyance direction of the recording medium. Then, side ends of the conveyed recording medium, which are parallel to the conveyance direction, are detected on the basis of whether or not the light-receiving element receives light emitted from the moving light-emitting element and reflected by the recording medium. With this process, a recording start position and a recording finish position in a scanning direction of the recording head can be determined.

SUMMARY OF THE INVENTION

However, when using such an inkjet recording apparatus, ink might be ejected onto a flat plate-shaped platen from a recording head, and the light emitted from a light-emitting element might be reflected in an unexpected direction due to the ink, and be detected by a light-receiving element. In such a case, there is a fear that a side end of a recording medium may be erroneously detected. Further, when the side end of the recording medium is erroneously detected, there is a possibility that ink may be ejected from the recording head onto a position where the recording medium does not exist. In such a case, the flat plate-shaped platen may be apt to be stained with ink, and thus the next recording medium may be apt to be stained with the ink when it passes on the flat plate-shaped platen. Consequently, a problem may occur in that the recording quality of an inkjet recording apparatus deteriorates.

Therefore, the invention provides a flat plate-shaped platen capable of improving the recording quality of a recording medium and an inkjet recording apparatus using the same.

According to one embodiment of the invention, a flat plate-shaped platen is used for an inkjet recording apparatus that includes a side-end detection unit and a recording head. The side-end detection unit moves a light emitting element, which faces a recording medium being conveyed in a conveyance direction, and a light receiving element in a direction intersecting with the conveyance direction while causing the light emitting element to emit light toward the recording medium. The side-end detection unit detects a side end of the recording medium on a basis of an amount of light received by the light receiving element. The recording head ejects ink selectively to form an image on the recording medium. The platen includes a blocking wall that prevents the ink ejected from the recording head from entering an area, which faces a movement area where the side-end detection unit moves. The blocking wall extends in a direction intersecting with the conveyance direction.

With this configuration, since the platen has the blocking wall that prevents the ink ejected from the recording head from entering an area, which faces a movement area where the side-end detection unit moves, ink can be prevented from entering the area facing the area where the side-end detection unit moves. Accordingly, erroneous detection of the side-end detection unit due to the entering of ink can be prevented. Thus, the recording quality on the recording medium can be improved.

According to one embodiment of the invention, an inkjet recording apparatus includes a conveyance unit, a side-end detection unit, a recording head, and a platen. The conveyance unit conveys a recording medium in a conveyance direction. The side-end detection unit moves a light emitting element, which faces a recording medium being conveyed in a conveyance direction, and a light receiving element in a direction intersecting with the conveyance direction while causing the light emitting element to emit light toward the recording medium. The side-end detection unit detects a side end of the recording medium on a basis of an amount of light received by the light receiving element. The recording head ejects ink selectively to form an image on the recording medium. The platen has a flat-plate shape. The platen is disposed at a position where the recording head ejects the ink. The platen supports the recording medium. The platen includes a blocking wall that prevents the ink ejected from the recording head from entering an area, which faces a movement area where the side-end detection unit moves. The blocking wall extends in a direction intersecting with the conveyance direction.

With this configuration, since the platen has the blocking wall that prevents the ink ejected from the recording head from entering an area, which faces a movement area where the side-end detection unit moves, ink can be prevented from entering the area of the platen facing the area where the side-end detection unit moves. Accordingly, erroneous detection of the side-end detection unit due to the entering of ink can be prevented. Thus, the recording quality on the recording medium can be improved.

DETAILED DESCRIPTION OF THE PREFERRED EMBODIMENT

Hereinafter, preferred embodiments of the flat plate-shaped platen and an inkjet recording apparatus according to the invention will be described with reference to the accompanying drawings. As an inkjet recording apparatus, this embodiment adopts a multifunction apparatus 1, which has a printing function, a copying function, a scanning function implemented by connecting it with a personal computer, and a facsimile function as well as a telephone function. The multifunction apparatus 1 includes an inkjet recording unit. Further, the invention may be applied to an inkjet printer having only a printing function. Further, this embodiment uses sheet or plastic film as recording media. However, the recording media are not limited thereto. Other various kinds of recording media may be used.

Figure 1:
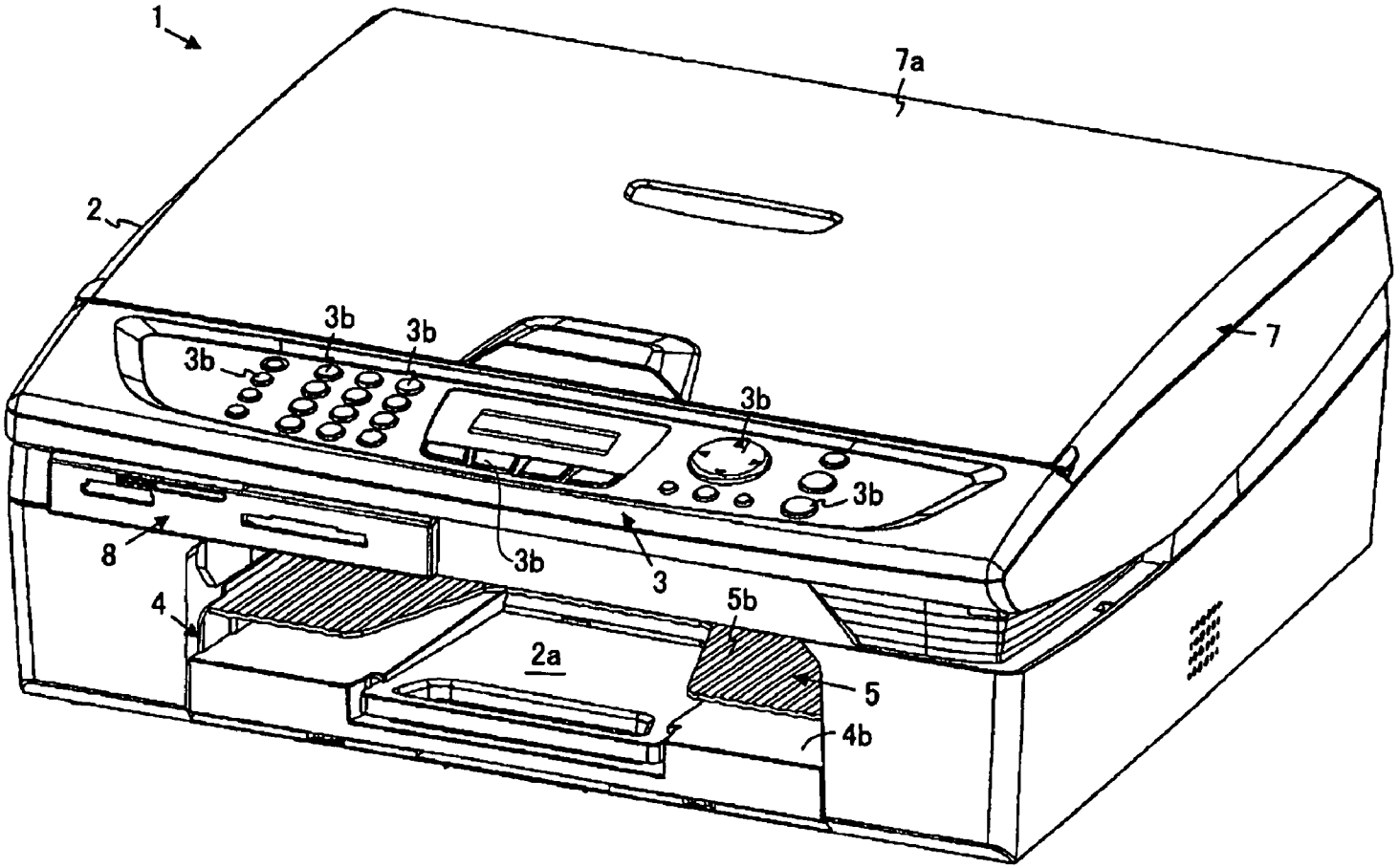
FIG. 1 is a perspective view illustrating a multifunction apparatus according to a first embodiment of the invention.
Figure 2:
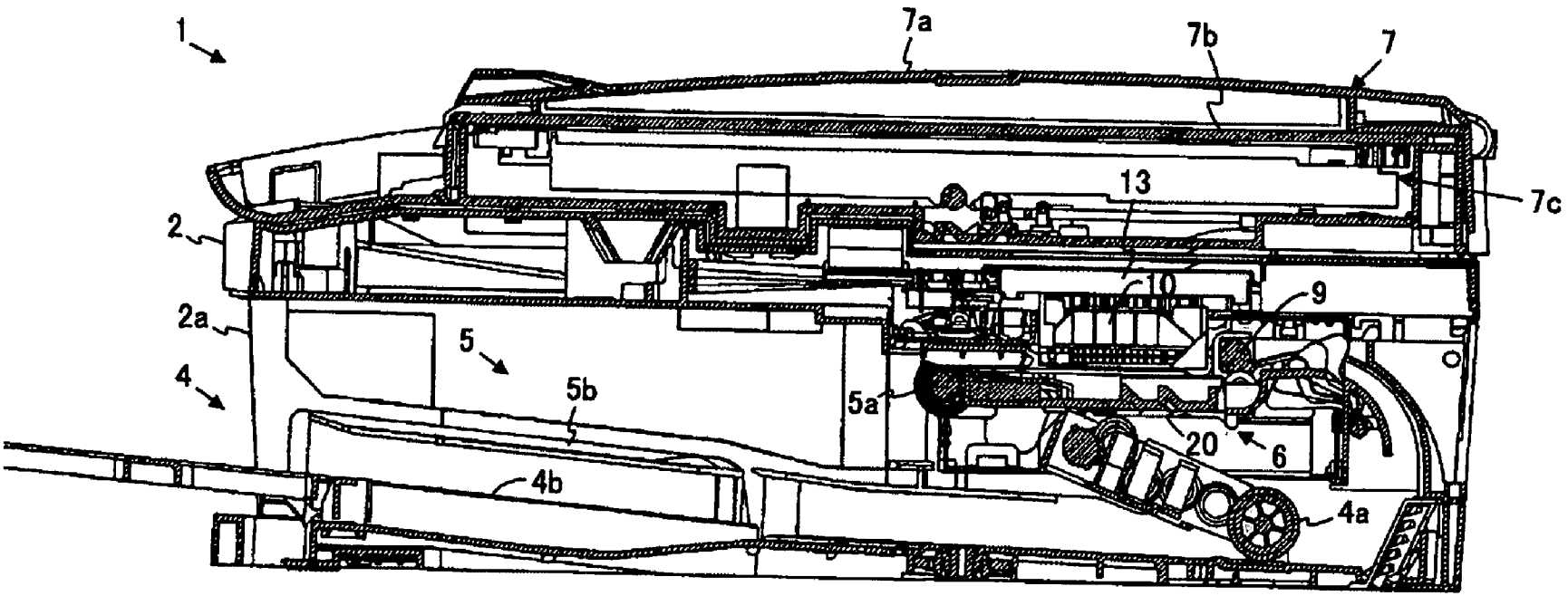
FIG. 2 is a side cross-sectional view illustrating the multifunction apparatus according to the first embodiment of the invention.
Figure 3:
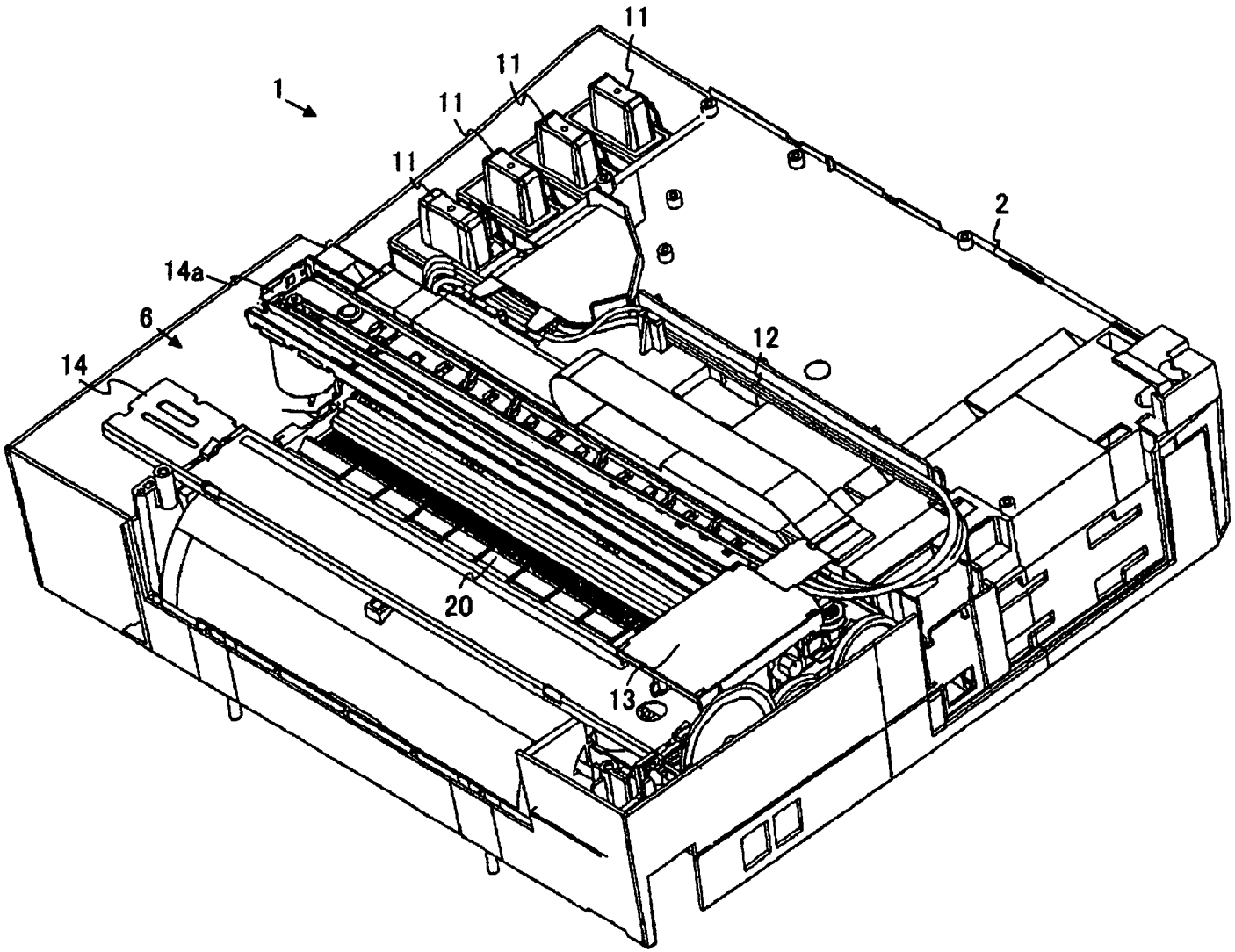
FIG. 3 is a perspective view illustrating a schematic structure of an inside of the multifunction apparatus according to the first embodiment of the invention.

FIG. 1 is a perspective view illustrating an appearance of the multifunction apparatus 1. FIG. 2 is a cross-sectional view of the multifunction apparatus 1 taken along the conveyance direction of a recording medium in FIG. 1. FIG. 3 is a perspective view illustrating a schematic structure of an inside of the multifunction apparatus 1.

First of all, the overall construction of the multifunction apparatus 1 will be described. In the following description, up, down, right and left directions in FIG. 1 are taken as the up, down, right and left of the multifunction apparatus 1 for the sake of convenience. However, orientation of the multifunction apparatus 1 in use is not limited thereto.

This multifunction apparatus 1 has a substantially rectangular parallelepiped casing 2 having a substantially rectangular opening 2*a* at its front. The size of the opening 2*a* is large enough to take in and take out a recording medium of a predetermined size. The multifunction apparatus 1 has an operating portion 3 provided at the front above the casing 2; a sheet feeding portion 4 and a sheet discharging portion 5 provided inside the opening 2*a* of the casing 2; a recording mechanism portion 6 (see FIG. 2) provided inside the casing 2; a document reading portion 7 provided at an upper portion of the casing 2; and a maintenance mechanism portion (not shown) that performs a maintenance processing of a recording head 10. In addition, an external memory inserting portion 8 for insertion of an external memory is provided at a side below the operating portion 3. The external memory herein includes, for example, compact flashes (registered trademark), smart media (registered trademark), memory sticks (registered trademark), SD cards (registered trademark), xDs (registered trademark), etc.

The document reading portion 7 has an upper cover 7*a*, which is configured to be rotatable up and down about a horizontal shaft at a rear end of the casing 2; a document placing glass 7*b* (FIG. 2) on which documents are placed when the upper cover 7*a* opens upward; and an image scanner mechanism portion 7*c* provided under the document placing glass 7*b*, for reading documents.

As shown in FIG. 2, the inside of the opening 2*a* of the multifunction apparatus 1 is divided into upper and lower portions. The lower portion of the opening 2*a* functions as the sheet feeding portion 4, which feeds a recording medium, and the upper portion of the opening 2*a* functions as the sheet discharging portion 5, which discharges the recorded recording medium.

In the multifunction apparatus 1, recording media (sheet, OHP sheet, etc.) are inserted into a sheet feeding tray 4*a* of the sheet feeding portion 4, and the uppermost one of the recording media are separated by a sheet feeding roller 4*a* of the sheet feeding portion 4 when recording is commanded by buttons 3*b*, 3*b*, . . . , and 3*b* provided in an operating panel 3*a* of the operating portion 3 or by PCs connected thereto. The separated recording medium is guided to the recording mechanism portion 6 by a conveyance roller 9. The recording head 10 selectively ejects ink from surfaces of nozzles of the recording head 10 in response to image signals, to record an image on a recording medium, while reciprocating in the width direction of the recording medium. Then, the recording medium on which an image is formed is discharged from the discharging tray 5*b* (sheet discharging portion 5) by a sheet discharging roller 5*a* of the sheet discharging portion 5.

On the other hand, when the upper cover is opened and documents are placed on the document placing glass 7*b*, the image scanner mechanism 7*c* reads the documents and transmits the data of the read documents through telephone line. Further, the multifunction apparatus 1 also has a function of converting the data transmitted through a telephone line into image signals. The image signals are recorded on the recording medium by the recording mechanism portion 6, and the recording medium on which an image is formed is discharged. As thus described, the multifunction apparatus 1 also has a facsimile function. Further, the present multifunction apparatus 1 also has a function as a copy machine. When a document to be copied is placed on the document placing glass 7*b*, the image scanner reads the document, and the recording mechanism portion 6 records the read document data, and the recording medium on which the document data are recorded are discharged from the sheet discharging portion 5. In this case, the documents having been read are discharged by the document discharger 7*b*.

As shown in FIG. 3, the recording mechanism portion 6 has a plurality of ink cartridges 11, 11, 11 and 11, which are respectively filled with color inks of four colors, i.e., cyan, magenta, yellow and black; a carriage 13 having the recording head 10, which is connected to the respective color inks in the ink cartridges 11 via tubes 12 to record an image on the recording medium; L-shaped guides 14 and 14*a*, which support both ends of the carriage 13; and a driving unit (not shown), which moves the carriage 13 along the L-shaped guides 14 and 14*a*. Further, the recording head 10 is driven by the driving unit and reciprocates on the L-shaped guides 14 and 14*a* extending in a direction (vertical direction) intersecting the conveyance direction of the recording medium. A nozzle surface, which jets (ejects) ink, is formed in the lower surface of the recording head 10.

On the other hand, although not shown, the driving unit, for example, has two pulleys, which are arranged below both ends of the one L-shaped guide 14*a*; an endless belt, which is wound around theses pulleys; and a driving motor, which is connected with one of the pulleys through a gear, etc. Also, when the one pulley is rotated by the driving of the driving motor (CR motor) forward or rearward, the cartridge 13, which is joined to the endless belt, reciprocates in a linear direction along the L-shaped guides 14 and 14*a* with the forward or rearward rotation of the pulley.

A conveyance roller 9, which extends in the reciprocating direction of the cartridge 13 and faces the recording head 10, is provided under the L-shaped guide 14*a*. This conveyance roller 9 is rotated in a predetermined rotating direction by a recording medium feeding motor (not shown) through a gear mechanism conveys the recording medium fed from the sheet feeding tray 4*a* while moving the recording medium substantially horizontally right under the recording head 10, and discharges it to the discharging tray 5*b*.

A left end of the cartridge 13 is equipped with an optical medium sensor (serving as a side-end detection unit), which faces downward. A flat plate-shaped platen 20 having an area that can hold the recording medium thereon is provided under the L-shaped guide 14*a*, in other words, at a position where ink is ejected from the nozzle surface of the recording head 10.

The medium sensor has a reflective sensor including a light-emitting element such as an LED and a light-receiving element such as a photo transistor. The medium sensor can detect presence or absence of a recording medium on the basis of an amount of light, which is emitted from the light-emitting element toward the recording medium and the flat plate-shaped platen 20, reflected by the recording medium, and then received by the light-receiving element. The medium sensor operates while moving along the L-shaped guide 14 to detect a side end of a recording medium. Thereby, a recording start position and a recording finish position of the recording head 10 in its moving direction are determined. Further, when the carriage 13 is moved right and left after the recording by the recording head 10, the medium sensor can scan the recorded image line by line. Therefore, the shade of the recorded image can be read as analog data.

Next, the flat plate-shaped platen 20 provided in the inkjet recording apparatus (multifunction apparatus 1) will be described.

Figure 4:
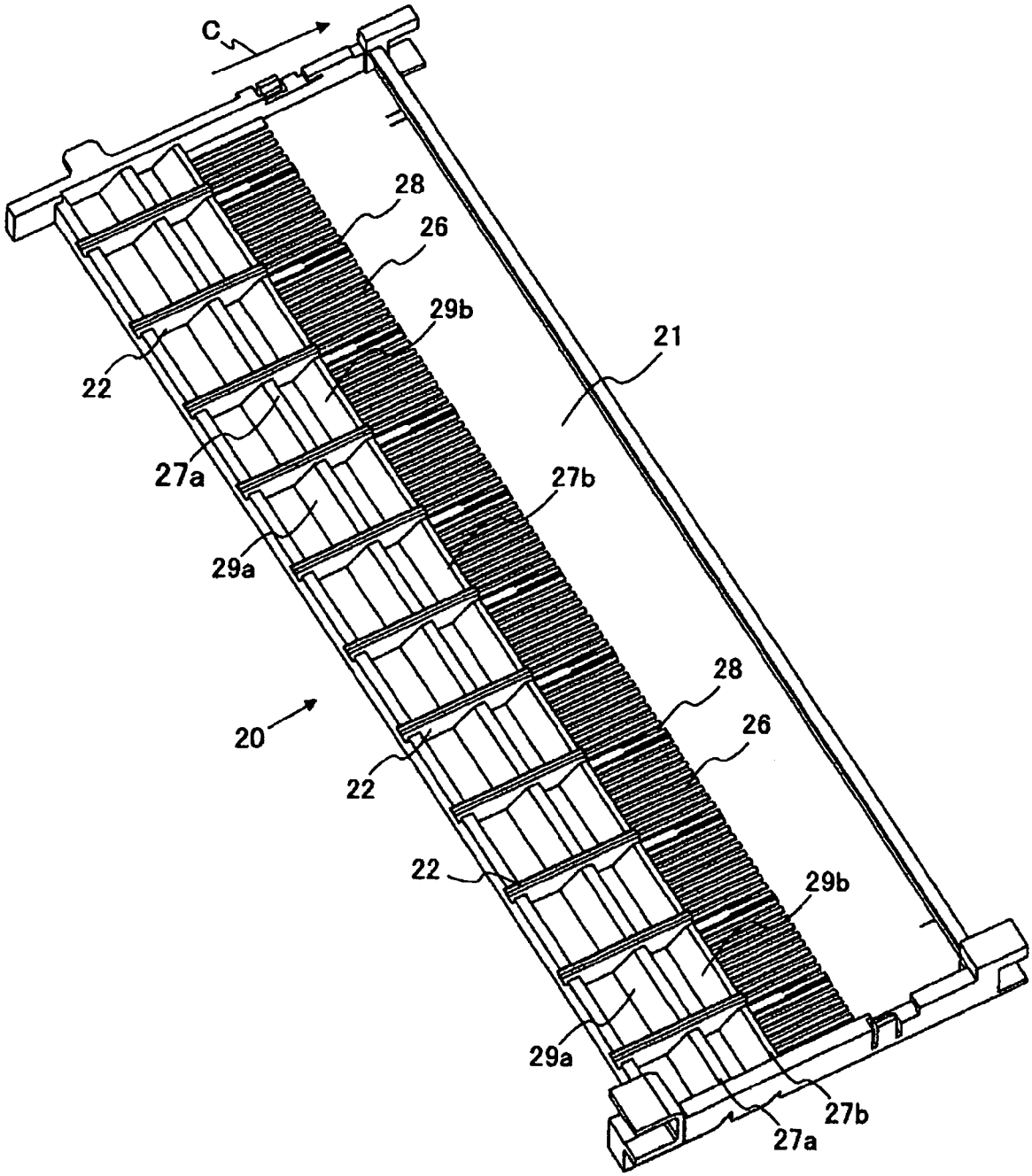
FIG. 4 is a perspective view illustrating a flat plate-shaped platen of the multifunction apparatus according to the first embodiment of the invention.
Figure 5:
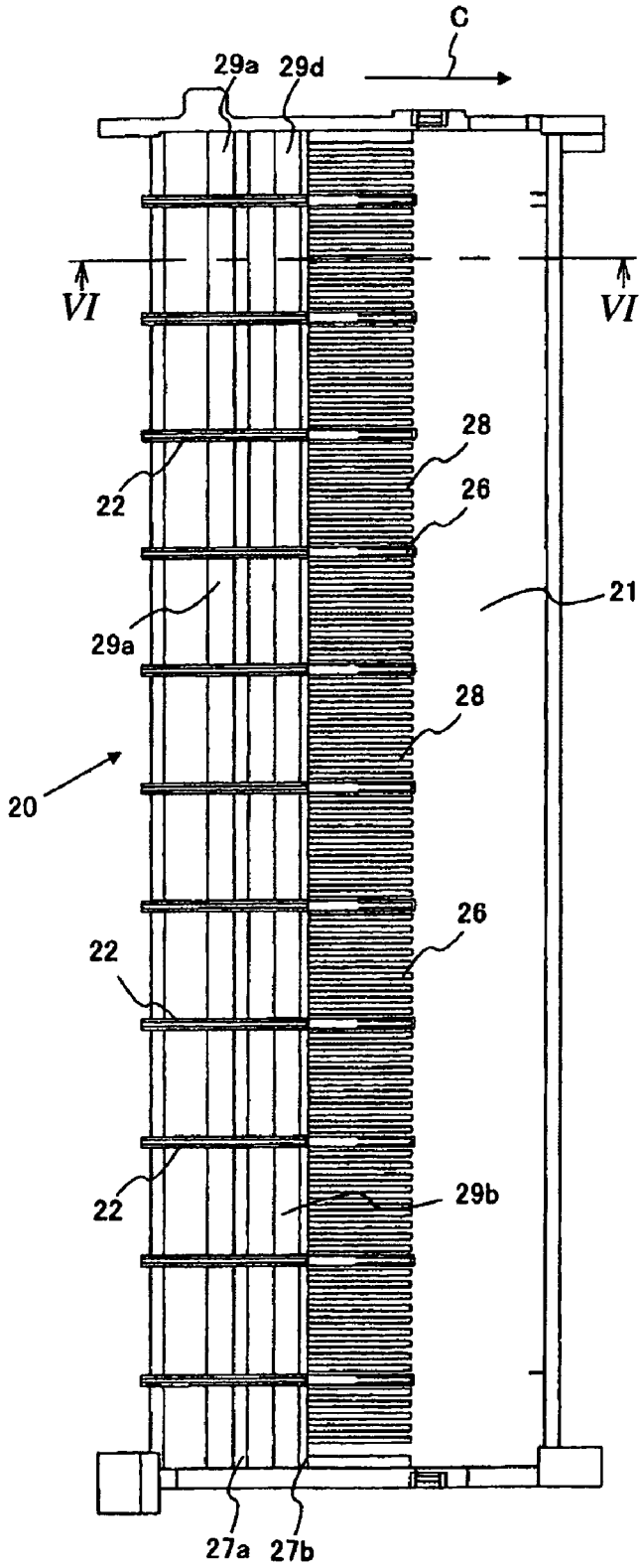
FIG. 5 is a front view illustrating the flat plate-shaped platen of the multifunction apparatus according to the first embodiment of the invention.
Figure 6:
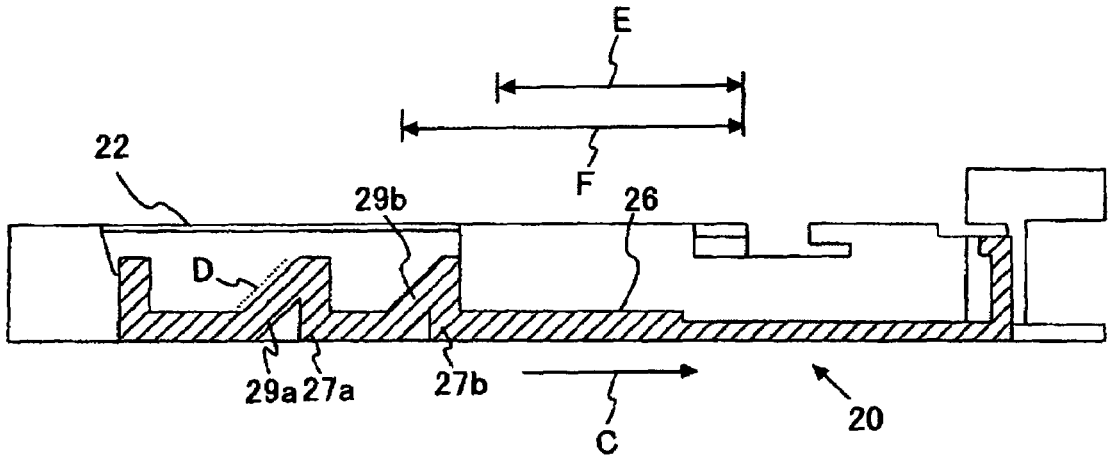
FIG. 6 is a cross-sectional view illustrating the section of the flat plate-shaped platen of the multifunction apparatus taken along a line VI-VI in FIG. 5.

FIGS. 4, 5 and 6 are a perspective view of the flat plate-shaped platen 20, a front view thereof, and a cross-sectional view thereof taken along the line VI-VI in FIG. 5, respectively. The flat plate-shaped platen 20 formed of a resin-molded product. A plurality of ribs 22 and 26 protrudes from a facing surface 21 that faces a recording medium.

The ribs 22 function as a contact area reducing member, which reduces a contact area between the platen 20 and a recording medium when the recording medium extending in the conveyance direction C of the recording medium is conveyed. The ribs 22 are juxtaposed in a direction substantially perpendicular to the conveyance direction C. Further, the ribs 26 are provided downstream of the ribs 22 and are juxtaposed in the direction substantially perpendicular to the conveyance direction C. The ribs 26 are lower in height than the ribs 22. The number of the ribs 26 is larger than that of the ribs 22. Upper ends of the ribs 22 and 26 are in contact with a recording medium being conveyed on the flat plate-shaped platen 20 to support the recording medium. The ribs 22 and 26 reduce a contact area between the flat plate-shaped platen 20 and a recording medium to reduce friction therebetween. Therefore, a recording medium can be smoothly conveyed on the flat plate-shaped platen 20.

The ribs 22 are disposed in a rear portion (a upstream portion in the conveyance direction C of a recording medium) of the flat plate-shaped platen 20 including an area (see an area D indicated by the broken lines in FIG. 7) facing an area where the medium sensor of the carriage 13 moves. On the other hand, the ribs 26 are separated from the ribs 22 by a blocking wall 27*b*, and are arranged at a front portion (a downstream portion in the conveyance direction C of a recording medium) of the flat plate-shaped platen 20. Further, the ribs 26 are lower in their height than the ribs 22. The number of the ribs 26 provided on the facing surface 21 of the flat plate-shaped platen 20 is larger than that of the ribs 22. The ribs 26 are arranged via the blocking wall 27*b* on extension lines, in the conveyance direction C, of portions where the respective ribs 22 are provided. With this structure of the flat plate-shaped platen 20, a leading end of a recording medium slides on the low ribs 26 as it away from the recording area, and floating of the recording medium in the recording area can be restrained. Thus, the recording medium can be smoothly conveyed.

Next, the flat plate-shaped platen 20 according to the first embodiment will be described in more detail with reference to FIGS. 4, 5 and 6.

The flat plate-shaped platen 20 has the blocking walls 27*a* and 27*b*, which prevent ink ejected by the recording head 10 from entering the area D (hereinafter, referred to as a medium sensor detecting area) facing the area where the medium sensor moves. The blocking walls 27*a* and 27*b* extend so as to intersect with the conveyance direction C of a recording medium. As shown in FIGS. 4 to 6, it is preferable that that the blocking walls 27*a* and 27*b* extend in a direction perpendicular to the conveyance direction C.

In order to prevent ink ejected by the recording head 10 from entering the medium sensor detecting area D, the flat plate-like platen 20 has at least one (27*a* in FIG. 6) of the blocking walls 27*a* and 27*b* on one side, where the medium sensor exists, of an area F where the recording head 10 ejects ink.

The number of the blocking walls is not particularly limited as long as it is one or more. However, as shown in FIG. 4 to 6, a plurality of blocking walls, for example, two blocking walls 27*a* and 27*b* may be provided.

Further, in a case where the recording head 10 performs recording on an edge of a recording medium, in other words, performs no-edge recording, it is preferable that the blocking wall 27*b* is provided on one side, where the medium sensor exists, of an area E where ink is directly ejected to perform recording on an edge of a recording medium as shown in FIG. 6.

In the area E where recording is performed on an edge of a recording medium, the recording head 10 ejects ink outside the edge of the recording medium as shown in FIG. 6. However, the blocking wall 27*b* can prevent the ink from entering the medium sensor detecting area D of the flat plate-shaped platen 20. Therefore, the ink can be prevented from entering the medium sensor detecting area D of the flat plate-shaped platen 20, so that the erroneous detection of the medium sensor caused by the entrance of ink can be prevented. As a result, the recording quality on a recording medium can be improved.

Further, it is preferable that that the wall 27*a* has an inclined surface 29*a*, which prevents the light emitted from the light-emitting element from being reflected toward the light-receiving element. This construction reflects the light emitted from the light-emitting element in directions where the light-receiving element does not exist when no recording medium exits on the flat plate-shaped platen 20, and reflects the light emitted from the light-emitting element in the direction that the light-receiving element exists when a recording medium exists on the flat plate-shaped platen 20. Thus, the medium sensor can precisely detect a side end of a recording medium.

Moreover, it is preferable that the inclined surfaces 29*a* and 29*b* at the blocking walls 27*a* and 27*b* are disposed upstream in the conveyance direction C (that is, on a side facing the upstream of the conveyance direction C). In other words, the inclined surfaces 29*a* and 29*b* have a slope, which becomes lower toward the upstream of the conveyance direction C of a recording medium. Such a construction can prevent jamming of a recording medium to thereby convey a recording medium smoothly.

Furthermore, it is preferable that the height of the blocking walls 27*a* and 27*b* are lower than that of the ribs 22. If the height of the blocking walls 27*a* and 27*b* are lower than that of the ribs 22, the function of the rib 22 as a contact area reducing member does not deteriorate. Therefore, a recording medium can be smoothly conveyed. Specifically, a recording medium is slid on the high ribs 22 and is guided by the high ribs 22. On the other hand, the low blocking walls 27*a* and 27*b* lifts a recording medium bending in the direction perpendicular to the conveyance direction C due to absorption of ink during recording. Therefore, the being of a recording medium can be prevented, and the high recording quality can be achieved.

A plurality of grooves 28 substantially parallel to the conveyance direction C of the recording medium are defined on one side (the area F), where the recording head 10 exists, of the blocking walls 27*a* and 27*b* in the flat plate-shaped platen 20. The expression "substantially parallel to the conveyance direction C" means that the grooves 28 are defined between the small ribs 26. Further, it is preferable that an ink-absorbing member, which absorbs ink guided to the grooves 28, are further provided downstream of the grooves 28. In addition, the expression "the grooves 28 are substantially parallel to the conveyance direction C" means that the grooves 28 are parallel enough to guide ink to the ink-absorbing member. Therefore, the grooves 28 may be more or less inclined.

Since the grooves 28 are defined, ink fallen on the ribs 26 or the grooves 28 easily flow through the grooves 28 due to the capillary phenomenon and is absorbed by the ink-absorbing member. Therefore, the spreading of ink is improved.

The shapes of the grooves 28 and the ribs 26 are not limited to the quadratic prismatic ribs 26 and the grooves 28 provided therebetween. For example, the ribs 26 may be the trigonal prismatic ribs. The trigonal prismatic may be arranged with gaps therebetween or with no gap therebetween, to thereby define the grooves 28 between the triangular hills.

Further, it is preferable that textures are formed on one side of the blocking walls 27*a* and 27*b* where the recording head 10 exits. If the texture is formed, the ink-repellant property of the facing surface 21, on the one side of the blocking wall 27 where the recording head 10 exists, increases. Thus, ink ejected by the recording head 10 and fallen on the ribs 26 or the grooves 28 flow easily. As a result, the ink is easily absorbed by the ink-absorbing member.

In order to form the textures, a surface of a molding die is etched to roughening surface roughness thereof. With using such a molding die, the textures are formed on a surface of a molded piece. Further, sand blasting may be performed with respect to the flat plate-shaped platen 20 in addition to the forming of the textures. Therefore, number of processes can be decreased by performing a matting treatment at the same time when the flat plate-shaped platen 20 is molded.

Further, it is preferable that the textures are formed at least at the bottom of the grooves 28. This construction increases the ink-repellant property of the grooves 28, and makes the ink fallen on the grooves 28 flow easily and be easily absorbed by the ink-absorbing member.

Figure 7:
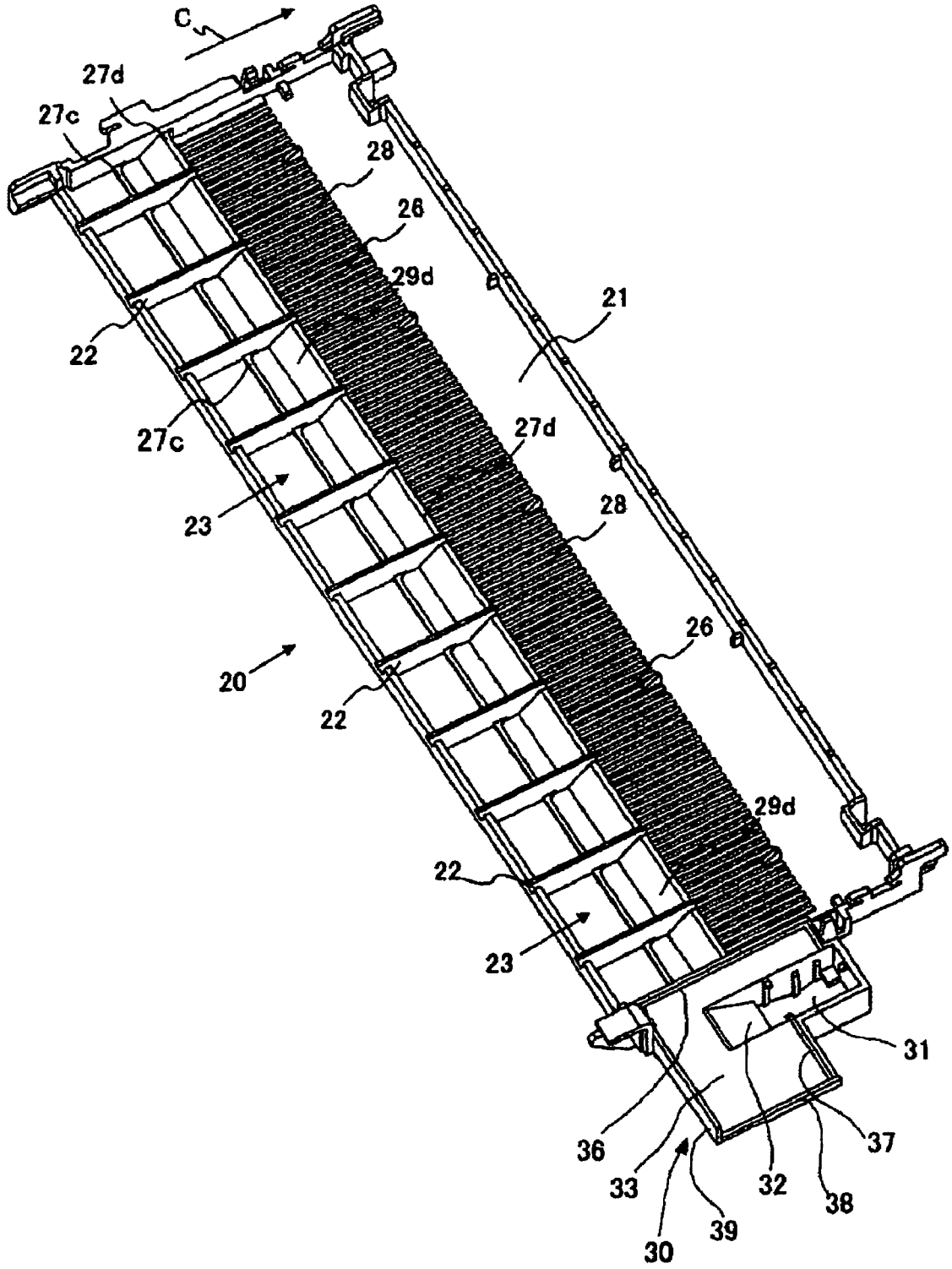
FIG. 7 is a perspective view illustrating a multifunction apparatus according to a second embodiment of the invention.
Figure 8:
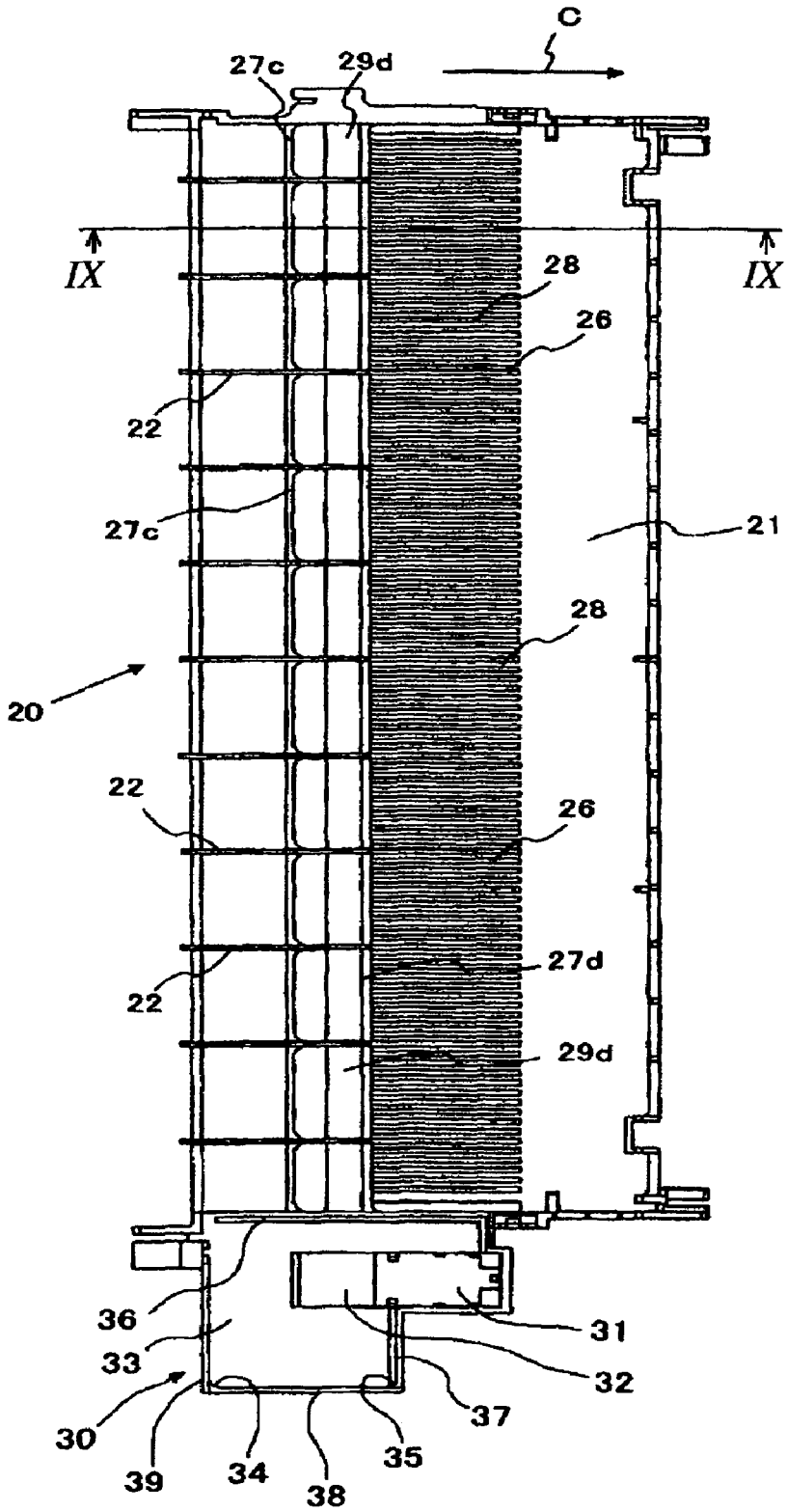
FIG. 8 is a front view illustrating a flat plate-shaped platen of the multifunction apparatus according to the second embodiment of the invention.
Figure 9:
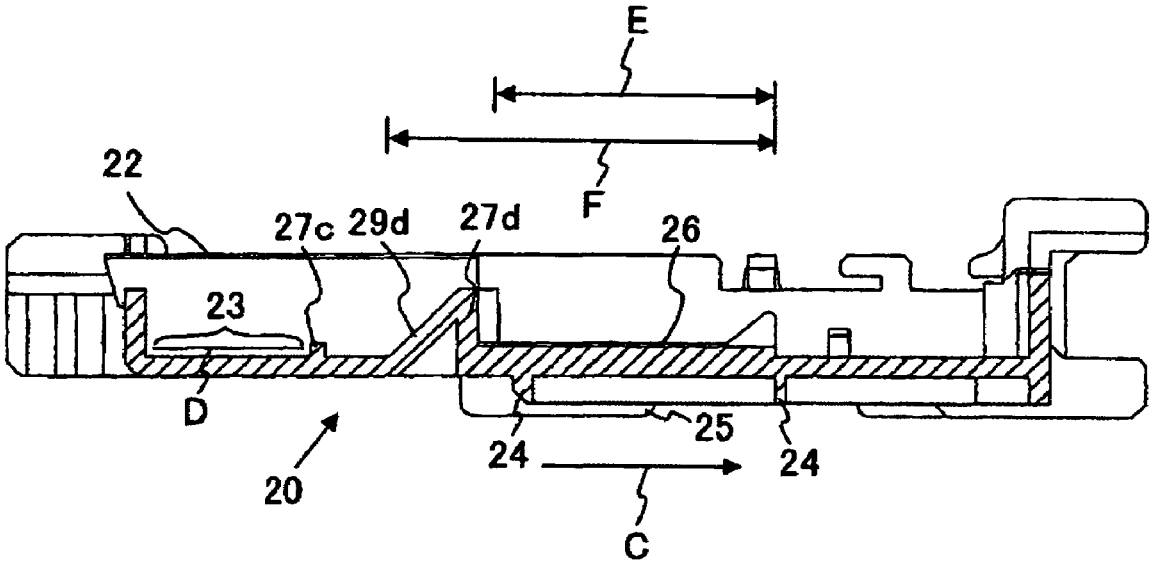
FIG. 9 is a cross-sectional view illustrating the section of the flat plate-shaped platen of the multifunction apparatus taken along a line IX-IX in FIG. 8.

Next, a flat plate-shaped platen 20 according to a second embodiment will be described with reference to FIGS. 7, 8 and 9. FIGS. 7, 8 and 9 are a perspective view of the flat plate-shaped platen 20 according to the second embodiment, a front view thereof, and a cross-sectional view taken along the line IX-IX in FIG. 8, respectively.

The flat plate-shaped platen 20 has two blocking walls 27*c* and 27*d*, which prevent ink ejected by the recording head 10 from entering the area D facing the area where the medium sensor (the side-end detection unit) moves. The blocking walls 27*c* and 27*d* extend in a direction intersecting with the conveyance direction C of a recording medium. As shown in FIGS. 7 to 9, it is preferable that the blocking walls 27*c* and 27*d* extend in a direction perpendicular to the conveyance direction C.

The blocking wall 27*d* provided downstream of the conveyance direction C has an inclined surface 29, similar to the blocking wall 27*b* of the first embodiment. The function of this inclined surface 29*d* is the same as that of the inclined surface 29*b* of the first embodiment. Further, in the case where the recording head 10 performs recording on an edge of a recording medium, it is preferable that the blocking wall 27*d* is provided on one side, where the medium sensor exists, of the area E where the ink is directly ejected to perform recording on the edge of a recording medium, as shown in FIG. 9.

The blocking wall 27*c* provided upstream of the conveyance direction C is provided at least further upstream than the area F where the recording head 10 ejects ink and further downstream than the medium sensor detecting area D. Also, the blocking wall 27*c* prevents the ink ejected by the recording head 10 from entering the medium sensor detecting area D.

It is preferable that the facing surface 21, on a medium sensor detecting area D side of the blocking wall 27*c*, is an anti-reflection treated portion 23 where an anti-reflection treatment has been performed. The light emitted from the light-emitting element of the medium sensor is reflected on the surface of the flat plate-shaped platen 20 or a recording medium, and then enters the light-receiving element. However, the light reflected by the anti-reflection treated portion 23 of the flat plate-shaped platen 20 rarely enters the light-receiving element due to scattered reflection or absorption. Therefore, the reflected light from the flat plate-shaped platen 20 can be restrained or prevented. On the other hand, a larger amount of the light reflected on the recording medium enters the light-receiving element. Therefore, a control unit (not shown) of the multifunction apparatus 1 can surely detect whether or not a recording medium exists on the basis of the amount of the light received by the medium sensor. Thus, a side end of a recording medium can be precisely determined.

For example, the anti-reflection treated portion 23 may be formed by forming a non-glossy surface by means of the matting treatment and then performing the anti-reflection treatment. The matting treatment may be performed by means of sand blasting or the texture process. In the texture process, textures are formed on the surface of a molded product by roughening the surface roughness of a molding die by means of etching. Therefore, the number of processes can be decreased by performing the matting treatment at the same time when the flat plate-shaped platen 20 is molded. In the present embodiment, as a pattern of the textures, HM3013 (with no gloss) manufactured by Nihon Etching Co., Ltd. is used.

Further, the anti-reflection treated portion 23 may be formed by bonding a sheet-like light-absorbing material that absorbs light onto the facing surface 21. With this construction, the emitted light from the light-emitting element is absorbed by the light-absorbing material, and the amount of the reflected light can be decreased.

Because matting treatment is performed on the medium sensor detecting area D, the light emitted from the light-emitting element of the medium sensor is reflected on the anti-reflection treated portion 23 in a scattering manner. Therefore, the light reflected on the facing surface 21 and captured by the light-receiving element is reduced, and the erroneous detection of a medium sensor at a position where the recording medium does not exist can be prevented. In other words, the detection accuracy of a side end of a recording medium can be improved. As a result, the positioning accuracy of the recording starting and finishing positions of the recording head in its moving direction can be improved.

Further, a flushing portion 30 is provided at an end of the flat plate-shaped platen 20 for receiving ink ejected during the flushing operation (which ejects ink from the recording head 10 irrespective of image recording) for preventing the clogging or drying of the recording head 10. The flushing operation is performed after the recording head 10 is moved to a position where the recording head 10 faces the flushing portion 30, at a predetermined timing during the recording, before the starting of the recording, or after the recording of a single recording medium.

The flushing portion 30 has an opening 31, an inclined surface 32, an ink-receiving face 33, and ink-guiding grooves 36 and 37. During the flushing operation, since the recording head 10 ejects ink at the position where the recording head 10 faces the opening 31 and the inclined surface 32, most of ink is directly absorbed by an waste liquid foam (not shown) provided at the bottom of the flushing portion 30 through the opening 31, or is caught by the inclined surface 32 and then guided into the opening 31, and finally absorbed by the waste liquid foam.

The ink-receiving face 33 is provided for catching fine ink mists generated by the flushing operation, and for preventing a part of the ink ejected during the flushing operation from falling at a place other than the opening 31 of the flat plate-shaped platen 20.

The ink caught by the ink-receiving face 33 coheres by the cohesive force of ink, which is liquid, and becomes a liquid drop, and thus can easily move on the ink-receiving face 33, and be guided to the guiding grooves 36 and 37 provided in the vicinity of the outer circumference of the ink-receiving face 33, and is finally led to the opening 31.

Further, ribs 38 and 39 are provided outside the ink-guiding grooves 37 around the outer circumference of the ink-receiving face 33 so as not to spill over the ink adhering to the ink-receiving face 33 out of the flat plate-shaped platen 20 when the whole apparatus is carried in its inclined state. Further, corners 34 and 35 are R-shaped so that the flow of ink is not impeded due to the surface tension.

Further, in the second embodiment of the flat plate-shaped platen 20, similar to the first embodiment of the flat plate-shaped platen 20, the ribs 26 are provided. However, the ribs are not essential elements of the flat plate-shaped platen 20 of the invention, and thus the ink-repellant property can be improved by forming textures without providing the ribs 26.

Further, as shown in FIG. 9, a lattice-like rib 24 may be provided to protrude from the rear face of the flat plate-shaped platen 20. The rib 24 protruding from the rear face can secure the strength of the flat plate-shaped platen 20 formed in the shape of a thin plate, and restrain the war page of the flat plate-shaped platen 20. Further, a projection 25 additionally protrudes from the rib 24 in substantially the middle of the flat plate-shaped platen 20 in its longitudinal direction. This projection 25 can restrain the war page of the flat plate-shaped platen 20 due to the excessive load applied to the flat plate-shaped platen 20 or the variation with the lapse of time by abutting the lower frame of the flat plate-shaped platen 20

Further, the blocking walls 27*a*, 27*b*, 27*c* and 27*d*, the inclined surfaces 29*a*, 29*b* and 29*d*, the ribs 22 and 26 etc. can be molded with resin at the same time when the flat plate-shaped platen 20 is molded.

What is claimed is:

1. A flat plate-shaped platen used for an inkjet recording apparatus that includes a side-end detection unit that moves a light emitting element, which faces a recording medium being conveyed in a conveyance direction, and a light receiving element in a direction intersecting with the conveyance direction while causing the light emitting element to emit light toward the recording medium, the side-end detection unit detecting a side end of the recording medium on a basis of an amount of light received by the light receiving element, and a recording head that ejects ink selectively to form an image on the recording medium, the platen comprising:

a blocking wall that prevents the ink ejected from the recording head from entering an area which faces a movement area where the side-end detection unit moves, the blocking wall extending in a direction intersecting with the conveyance direction and having an inclined surface that prevents the light emitted from the light emitting element from being reflected toward the light receiving element, the inclined surface being disposed upstream of the blocking wall in the conveyance direction.

2. The platen according to claim 1, wherein the blocking wall is disposed on one side of an area where the recording head ejects the ink, the side-end detection unit existing on the one side of the area.

3. The platen according to claim 1, wherein the blocking wall includes a plurality of blocking walls.

4. The platen according to claim 1, further comprising:

a contact area reducing member that reduces a contact area between the platen and the recording medium when the recording medium is conveyed in the conveyance direction, wherein:

height of the contact area reducing member is larger than that of the blocking wall.

5. The platen according to claim 1, further comprising:

a plurality of grooves that extends to be substantially parallel to the conveyance direction, the grooves defined on one side of the blocking wall where the recording head exists; and an ink absorbing member that absorbs ink guided to the grooves.

6. The platen according to claim 5, wherein:

a texture is formed on the one side of the blocking wall where the recording head exists; and the texture is formed on bottom surfaces of the grooves.

7. The platen according to claim 1, wherein a texture is formed on one side of the blocking wall where the recording head exists.

8. The platen according to claim 1, wherein an anti-reflection processing is applied to the area facing the side-end detection unit.

9. The platen according to claim 1, wherein the light emitting element emits light to the area, which faces the movement area where the side-end detection unit moves.

10. The platen according to claim 1, wherein the recording head moves in a first area and the light emitting element and the light receiving element move in a second area, and wherein the blocking wall is located between the first area and the second area in the conveying direction.

11. An inkjet recording apparatus comprising:

a conveyance unit that conveys a recording medium in a conveyance direction;

a side-end detection unit that moves a light emitting element, which faces a recording medium being conveyed in a conveyance direction, and a light receiving element in a direction intersecting with the conveyance direction while causing the light emitting element to emit light toward the recording medium, the side-end detection unit detecting a side end of the recording medium on a basis of an amount of light received by the light receiving element;

a recording head that ejects ink selectively to form an image on the recording medium; and a platen having a flat-plate shape, the platen disposed at a position where the recording head ejects the ink, the platen supporting the recording medium, wherein:

the platen having a blocking wall that prevents the ink ejected from the recording head from entering an area, which faces a movement area where the side-end detection unit moves, the blocking wall extending in a direction intersecting with the conveyance direction and having an inclined surface that prevents the light emitted from the light emitting element from being reflected toward the light receiving element, the inclined surface being disposed upstream of the blocking wall in the conveyance direction.

12. The inkjet recording apparatus according to claim 11, wherein the blocking wall is disposed on one side of an area where the recording head ejects the ink, the side-end detection unit existing on the one side of the area.

13. The inkjet recording apparatus according to claim 11, wherein the blocking wall includes a plurality of blocking walls.

14. The inkjet recording apparatus according to claim 11, wherein:

the platen further comprises a contact area reducing member that reduces a contact area between the platen and the recording medium when the recording medium is conveyed in the conveyance direction; and height of the contact area reducing member is larger than that of the blocking wall.

15. The inkjet recording apparatus according to claim 11, wherein:

the platen further comprises:

a plurality of grooves that extends to be substantially parallel to the conveyance direction, the grooves defined on one side of the blocking wall where the recording head exists; and an ink absorbing member that absorbs ink guided to the grooves.

16. The inkjet recording apparatus according to claim 15, wherein:

a texture is formed in the platen on the one side of the blocking wall where the recording head exists; and the texture is formed on bottom surfaces of the grooves.

17. The inkjet recording apparatus according to claim 11, wherein a texture is formed in the platen on one side of the blocking wall where the recording head exists.

18. The inkjet recording apparatus according to claim 11, wherein an anti-reflection processing is applied to the area on the platen, facing the side-end detection unit.

19. A platen mountable to an inkjet recording apparatus including a recording head that is configured to move in a first movement area and to eject ink on a recording medium being conveyed in a conveying direction, and a side-end detection unit that is configured to move in a second movement area and to detect a side-end of the recording medium, the platen comprising:

a base; and a blocking wall that protrudes from the base and is located between the first movement area and the second movement area in the conveying direction, the blocking wall having an inclined surface that prevents the light emitted from the light emitting element from being reflected toward the light receiving element, the inclined surface being disposed upstream of the blocking wall in the conveyance direction.

20. The platen according to claim 19, further comprising:

a plurality of ribs that protrude from the base and located opposite from the first movement area with respect to the blocking wall in the conveying direction.

21. The platen according to claim 20, wherein the blocking wall further comprises:

a plurality of blocking walls, each being disposed between adjacent two of the plurality of ribs.

22. The platen according to claim 19, wherein the inclined surface is inclined from a surface of the base and is located opposite from the first movement area with respect to the blocking wall in the conveying direction.

* * * * *